US007083386B2

(12) United States Patent
Horng et al.

(10) Patent No.: US 7,083,386 B2
(45) Date of Patent: Aug. 1, 2006

(54) FAN WHEEL ASSEMBLY FOR CONNECTING MULTIPLE HUB RINGS

(75) Inventors: Alex Horng, Kaohsiung (TW); Yin-Rong Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 32 days.

(21) Appl. No.: 10/976,903

(22) Filed: Nov. 1, 2004

(65) Prior Publication Data

US 2006/0093485 A1 May 4, 2006

(51) Int. Cl.
*F04D 29/38* (2006.01)

(52) U.S. Cl. ..... 416/175; 416/200 R

(58) Field of Classification Search ..... 416/2, 416/62, 120, 122, 124, 175, 198 R, 200 R, 416/212 R, 223 R; 415/65, 66, 60
See application file for complete search history.

(56) References Cited

U.S. PATENT DOCUMENTS

| | | | | |
|---|---|---|---|---|
| 6,318,964 | B1 | 11/2001 | Yang | |
| 6,572,336 | B1 | 6/2003 | Horng et al. | |
| 2003/0063975 | A1* | 4/2003 | Horng et al. | 416/198 R |
| 2003/0185682 | A1* | 10/2003 | Lei et al. | 416/183 |

* cited by examiner

*Primary Examiner*—Edward K. Look
*Assistant Examiner*—Richard A. Edgar
(74) *Attorney, Agent, or Firm*—Bacon & Thomas

(57) ABSTRACT

A fan wheel assembly includes at least three hub rings and a connecting member. Each outer circumference of the hub rings provides with extension fan blades. The connecting member serially connects the hub rings which are coaxially stacked in a longitudinal direction to constitute the fan wheel assembly. Each extension fan blade of one of the hub rings extends into two adjacent extension fan blades of the other two of the hub rings that each leading edge of one layer of the extension fan blades overlaps the other two layers of the extension fan blades along a longitudinal direction. Thereby, the overlapped extension fan blades can increase total blade-surface area of the fan wheel assembly.

13 Claims, 6 Drawing Sheets

FAN WHEEL ASSEMBLY FOR CONNECTING MULTIPLE HUB RINGS

BACKGROUND OF THE INVENTION

1. Field of the Invention

The present invention relates to a fan wheel assembly for connecting multiple hub rings. Particularly, the present invention relates to the fan wheel assembly for coaxially connecting at least three hub rings and fan blades thereof. More particularly, the present invention relates to the fan wheel assembly for hub rings having first-layer fan blades overlapped second-layer and third-layer fan blades along a longitudinal direction.

2. Description of the Related Art

Referring initially to FIGS. 1 and 2, it illustrates a conventional fan wheel structure in accordance with the prior art. Typically, the fan wheel structure is an axial-flow type of a heat-dissipating fan wheel 1. Generally, the fan wheel 1 includes a hub 11, a plurality of fan blades 12 and a rotary shaft 13. The rotary shaft 13 is adapted to freely connect to a motor stator (not shown) for rotational operation. Each of the fan blades 12 tilts on an outer circumference of the hub 11 and is widely used to drive ambient air. And each of the fan blades 12 includes a leading edge 121 and a trailing edge 122 at its opposite sides.

Generally, the fan wheel 1 is made of plastic material molded in a molding assembly (not shown), and embedded a distal end of the rotary shaft 13 which is made of metal material. In pattern-drawing operation, it is risked that the molding assembly may obstruct and limit the pattern for releasing therefrom. In order to avoid obstructing the pattern in the molding assembly, each leading edge 121 of the fan blades 12 is designed not to overlap each corresponding trailing edge 122 of the adjacent fan blades 12 along a reference line identified as "W" extending in a longitudinal direction.

Furthermore, the total air amount driven by the fan wheel 1 is proportional to total number or total blade-surface area of the driving fan blades 12 according to aerodynamics. Therefore, total number or total blade-surface area of the driving fan blades 12 must be increased to enlarge total driven air amount on condition that the obstruction of the molding assembly is overcome in pattern-drawing operation.

Another construction of the conventional fan wheel is disclosed in U.S. Pat. Nos. 6,572,336 and 6,318,964. Turning now to FIGS. 3 and 4, it illustrates another conventional assembled fan wheel structure in accordance with the prior art. Generally, the fan wheel 1' includes an assembled hub 11' and a plurality of assembled fan blades 12'. The assembled hub 11' consists of an upper hub 11*a* and a lower hub 11*b*. The upper hub 11*a* provides with a plurality of upper fan blades 12*a* while the lower hub 11*b* providing with a plurality of lower fan blades 12*b*. Each of the assembled fan blades 12' consists of the upper fan blade 12*a* and the lower fan blade 12*b*, and includes a leading edge 121' and a trailing edge 122'. By such an assembled relationship, each starting point of the leading edge 121' of the assembled fan blade 12' is permitted to overlap each of the adjacent trailing edge 122' along a reference line identified as "X" extending in a longitudinal direction. Thereby, it permits an increase of total number and total blade-surface area of the assembled fan blades 12'.

However, there exist several drawbacks of the assembled fan blades 12' in use. In this assembling manner, total number of the assembled fan blade 12' disposed on the outer circumference of the fan wheel of the fan wheel 1' is limited. Inevitably, remained between the upper fan blade 12*a* and the lower fan blade 12*b* is a clearance due to failure in adhesion or deviation in alignment for assembling operation. Consequently, it results in not only deteriorating quality but also declining throughput of the fan wheel 1'. Hence, there is a need for a fan wheel to increase total number of the fan blades on the outer circumference of the fan wheel. The present invention intends to provide a fan wheel assembly for connecting at least three hub rings that constitutes first-layer fan blades overlapped second-layer and third-layer fan blades along a longitudinal direction. After assembling, each leading edge of one layer of the fan blades overlaps the other two layers of the fan blades along a longitudinal direction. The overlapped fan blades can increase assembled quality and broaden design of the fan wheel assembly in such a way to mitigate and overcome the above problem.

SUMMARY OF THE INVENTION

The primary objective of this invention is to provide a fan wheel assembly for connecting at least three hub rings that constitutes first-layer fan blades overlapped second-layer and third-layer fan blades along a longitudinal direction. Thereby, the overlapped fan blades can increase assembled quality and broaden design of the fan wheel assembly.

The secondary objective of this invention is to provide the fan wheel assembly for connecting at least three hub rings. Each fan blade of the hub rings has an extension blade to form a leading edge or a trailing edge that constitutes first-layer fan blades overlapped second-layer and third-layer fan blades along a longitudinal direction. Thereby, the overlapped extension blades can increase assembled quality and broaden design of the fan wheel assembly.

The fan wheel assembly in accordance with the present invention includes at least three hub rings and a connecting member. Each outer circumference of the hub rings provides with extension fan blades. The connecting member serially connects the hub rings which are coaxially stacked in a longitudinal direction to constitute the fan wheel assembly. Each extension fan blade of one of the hub rings extends into two adjacent extension fan blades of the other two of the hub rings that each leading edge of one layer of the extension fan blades overlaps the other two layers of the extension fan blades along a longitudinal direction. Thereby, the overlapped extension fan blades can increase total blade-surface area of the fan wheel assembly.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings wherein.

DETAILED DESCRIPTION OF THE INVENTION

Figure 5:
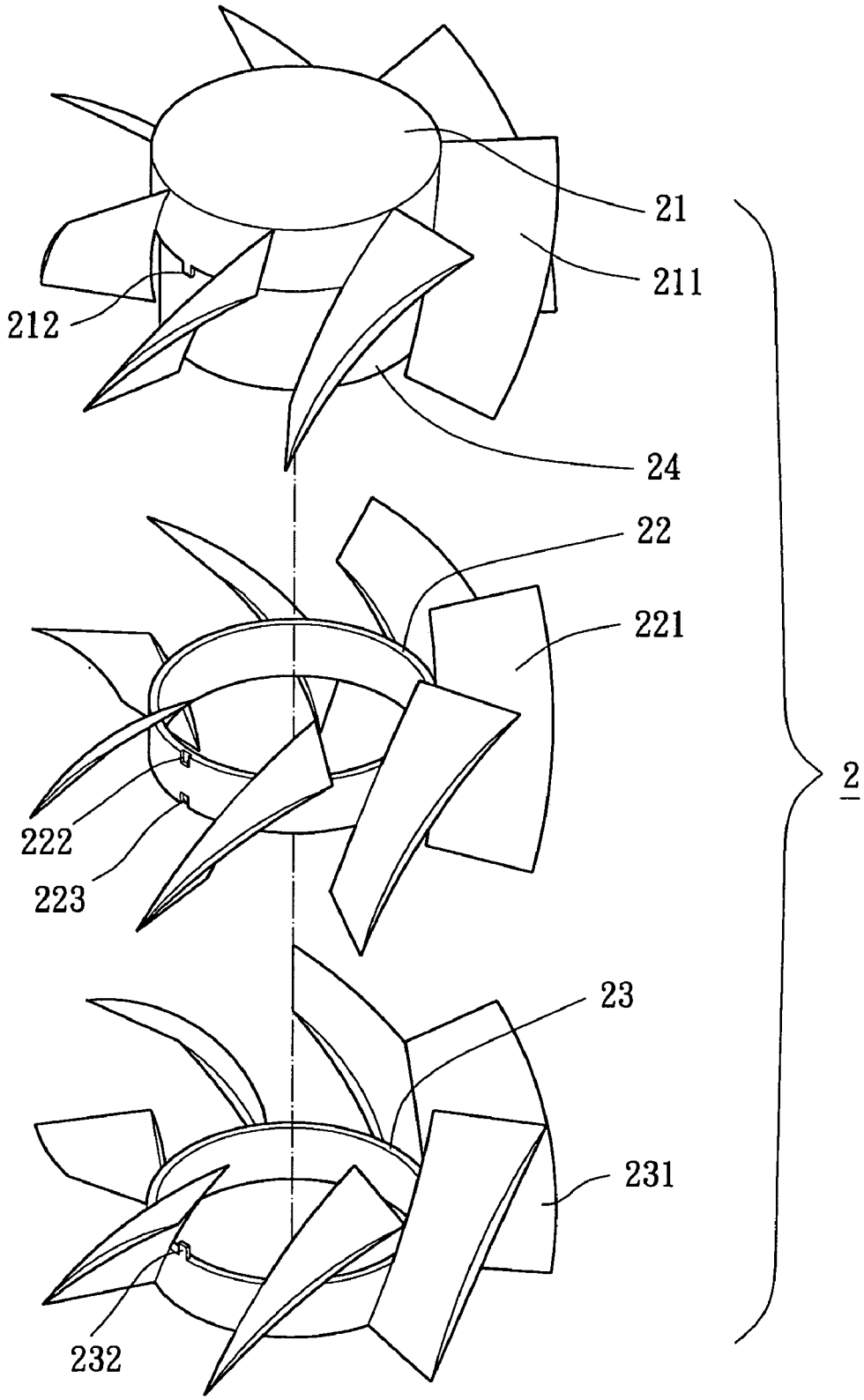
FIG. 5 is an exploded perspective view of a fan wheel assembly for connecting multiple hub rings in accordance with a first embodiment of the present invention.
Figure 6:
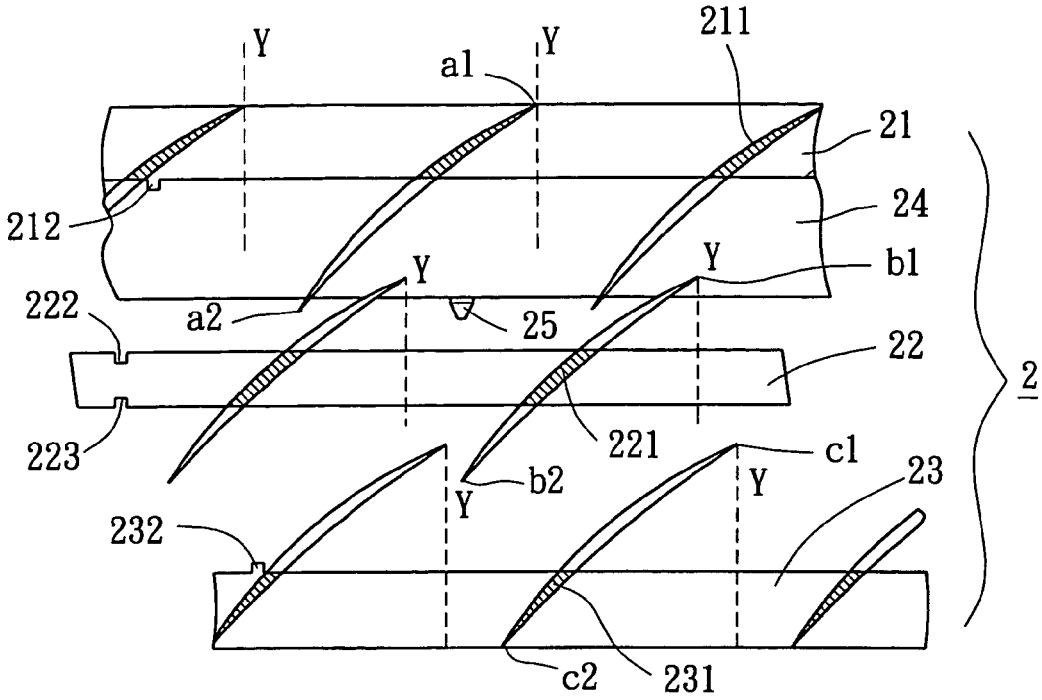
FIG. 6 is an exploded schematic, perspective view of the fan wheel assembly for connecting multiple hub rings in accordance with the first embodiment of the present invention.

Referring to FIGS. 5 and 6, a fan wheel assembly in accordance with a first embodiment of the present invention is applied to an axial-flow type fan wheel 2. Typically, the fan wheel 2 includes an upper hub unit 21, at least one intermediate hub unit 22, a lower hub unit 23 and a connecting member 24. Generally, each of the upper hub unit 21, the intermediate hub unit 22 and the lower hub unit 23 are separately prefabricated and made of plastic material molded in a molding assembly (not shown). In assembling operation, the connecting member 24 serially connects the upper hub unit 21, the intermediate hub unit 22 and the lower hub unit 23 which are coaxially stacked in succession in a longitudinal direction to constitute the fan wheel assembly 2.

Still referring to FIGS. 5 and 6, construction of the upper hub unit 21 shall be described in detail. The upper hub unit 21 is a separate hub ring member. The upper hub unit 21 includes a plurality of first extension fan blades 211 and at least one engaging member 212. The first extension fan blades 211 constitute first-layer fan blades, and each of the first extension fan blades 211 is a one-piece blade. The first extension fan blades 211 are equi-spaced and securely connected to an outer circumference of the upper hub unit 21. To avoid obstruction of the molding assembly, any two adjacent extension fan blades 211 cannot be overlapped in a reference line identified as "Y" extending along a longitudinal direction. Consequently, the upper hub unit 21 can be obstructed in the molding assembly in pattern-drawing operation. A leading edge (a1) of the extension fan blade 211 is substantially parallel to a top surface of the upper hub unit 21. Correspondingly, a trailing edge (a2) of the extension fan blade 211 is extended beyond a bottom plane of the upper hub unit 21. As to the engaging member 212, it is a protrusion extended from and formed on a bottom circumferential edge of the upper hub unit 21. Alternatively, the engaging member 212 is a notch extracted on the bottom circumferential edge of the upper hub unit 21. Furthermore, the upper hub unit 21 mounts a rotary shaft 25 at its center and thus combines with a motor structure (not shown).

Still referring to FIGS. 5 and 6, construction of the intermediate hub unit 22 shall be described in detail. The intermediate hub unit 22 is also a separate hub ring member. The intermediate hub unit 22 includes a plurality of second extension fan blades 221 and at least two engaging members 222, 223. The second extension fan blades 221 constitute second-layer fan blades, and each of the second extension fan blades 221 is a one-piece blade. The second extension fan blades 221 are equi-spaced and securely connected to an outer circumference of the upper hub unit 22. To avoid obstruction of the molding assembly, any two adjacent extension fan blades 221 cannot be overlapped in a reference line identified as "Y" extending along a longitudinal direction. Consequently, the intermediate hub unit 22 can be obstructed in the molding assembly in pattern-drawing operation. A leading edge (b1) of the extension fan blade 221 is extended beyond a top plane of the intermediate hub unit 22. Correspondingly, a trailing edge (b2) of the extension fan blade 221 is further extended beyond a bottom plane of the intermediate hub unit 22. The engaging members 222, 223 are notches extracted on the top and bottom circumferential edges of the intermediate hub unit 22. Alternatively, the engaging members 222, 223 are protrusions extended on the top and bottom circumferential edges of the intermediate hub unit 22.

Still referring to FIGS. 5 and 6, construction of the lower hub unit 23 shall be described in detail. The lower hub unit 23 is also a separate hub ring member. The lower hub unit 23 includes a plurality of third extension fan blades 231 and at least one engaging member 232. The third extension fan blades 231 constitute third-layer fan blades, and each of the third extension fan blades 231 is a one-piece blade. The third extension fan blades 231 are equi-spaced and securely connected to an outer circumference of the lower hub unit 23. To avoid obstruction of the molding assembly, any two adjacent extension fan blades 231 cannot be overlapped in a reference line identified as "Y" extending along a longitudinal direction. Consequently, the lower hub unit 23 can be obstructed in the molding assembly in pattern-drawing operation. A leading edge (c1) of the extension fan blade 231 is extended beyond a top plane of the lower hub unit 23. Correspondingly, a trailing edge (c2) of the extension fan blade 231 is substantially parallel to a bottom plane of the lower hub unit 23. As to the engaging member 232, it is a protrusion extended from and formed on a top circumferential edge of the lower hub unit 23. Alternatively, the engaging member 232 is a notch extracted on the top circumferential edge of the lower hub unit 23.

Referring again to FIG. 5, preferably, the connecting member 24 is a separate tube member made of relatively rigid metal material or the like. Desirably, the connecting member 24 is pre-connected with one of the upper hub unit 21, the intermediate hub unit 22 and the lower hub unit 23 for ease manufacture.

Figure 7:
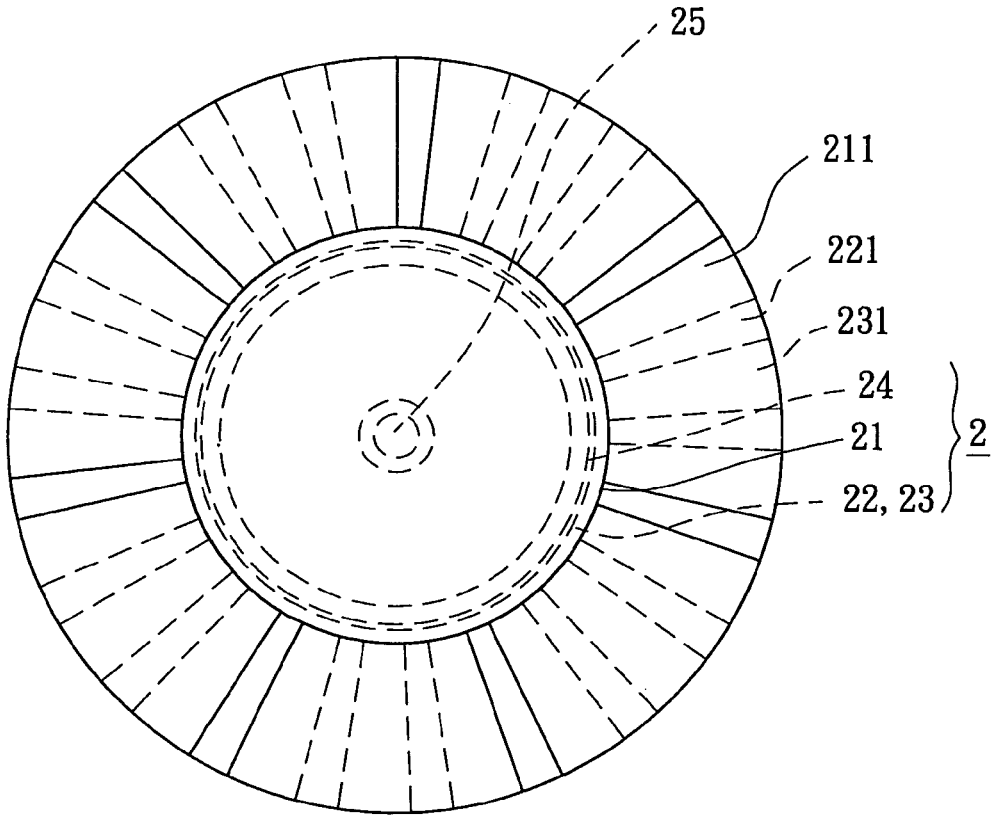
FIG. 7 is a top plan view of the fan wheel assembly for connecting multiple hub rings in accordance with the first embodiment of the present invention.
Figure 8:
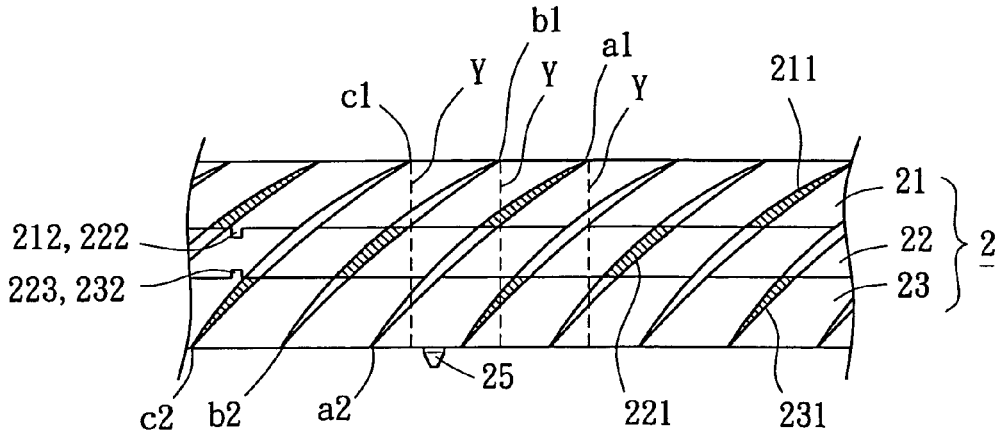
FIG. 8 is a side elevational, schematic view of the assembled fan wheel assembly for connecting multiple hub rings in accordance with the first embodiment of the present invention.

Turning now to FIGS. 7 and 8, in assembling operation, the connecting member 24 successively extends through the upper hub unit 21, the intermediate hub unit 22 and the lower hub unit 23. Preferably, the connecting member 24 securely mounts the upper hub unit 21, the intermediate hub unit 22 and the lower hub unit 23 by means of high-frequency heating or adhesive to constitute the fan wheel assembly 2. The engaging members 212, 222 are engaged each other in a longitudinal direction, and the engaging members 223, 232 are engaged each other. Consequently, the first extension fan blade 211, the second extension fan blade 221 and the third extension fan blade 231 are staggered and equi-spaced. After assembling, the leading edges (a1, b1, c1) of all of the extension fan blades 211, 221, 231 are substantially parallel to the top surface of the upper hub unit 21 while the trailing edges (a2, b2, c2) of all of the extension fan blades 211, 221, 231 being substantially parallel to the bottom plane of the lower hub unit 23, as best shown in FIG. 8. Each extension fan blades 211, 221, 231 of one of the hub units 21, 22, 23 extends into two adjacent extension fan blades 211, 221, 231 of the other two of the hub units 21, 22, 23 that each leading edge (a1, b1, c1) of one layer of the extension fan blades 211, 221, 231 overlaps the other two layers of the extension fan blades 211, 221, 231 in a reference line identified as "Y" along a longitudinal direction, as best shown in FIG. 8. Thereby, the overlapped extension fan blades 211, 221, 231 can increase total blade-surface area of the fan wheel assembly 2.

Figure 1:
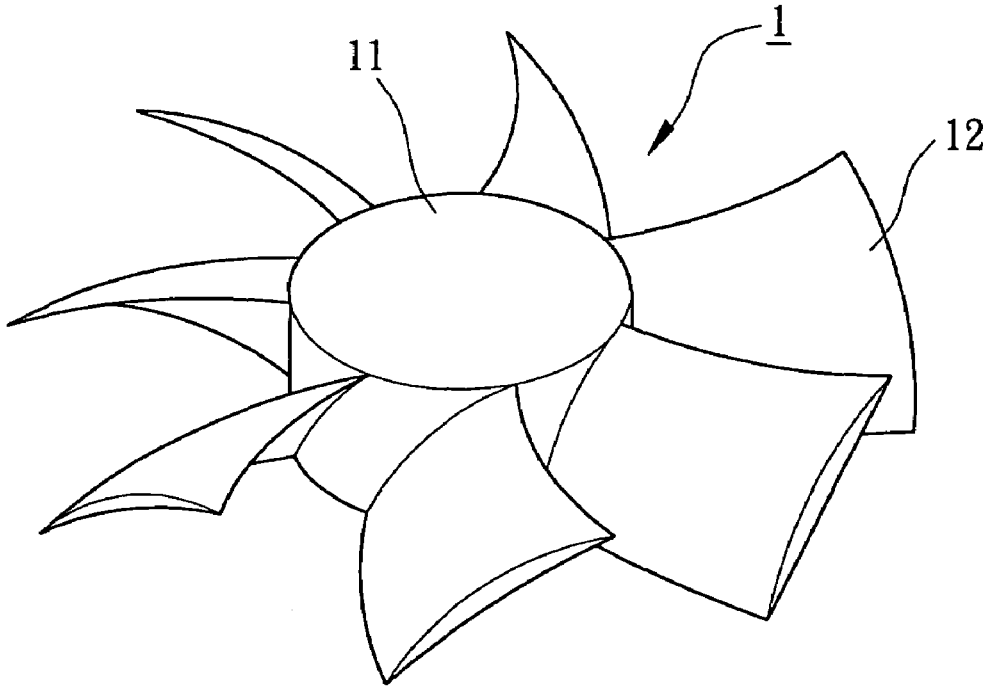
FIG. 1 PRIOR ART
FIG. 1 is a perspective view of a conventional fan wheel structure in accordance with the prior art.
Figure 2:
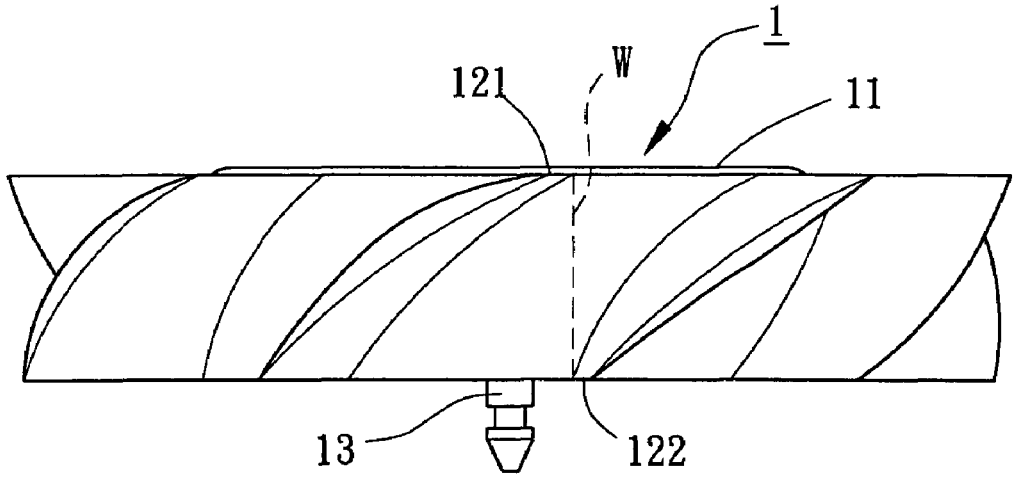
FIG. 2 PRIOR ART
FIG. 2 is a side elevational view of the conventional fan wheel structure in accordance with the prior art.
Figure 3:
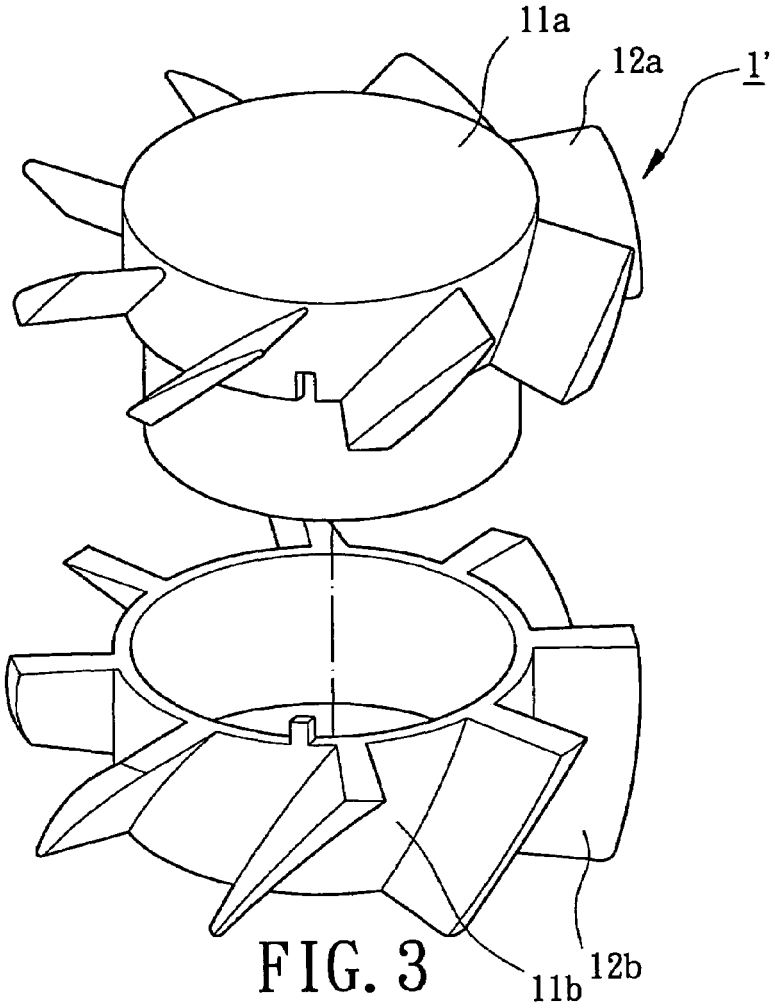
FIG. 3 PRIOR ART
FIG. 3 is an exploded perspective view of another assembled fan wheel structure in accordance with the prior art.
Figure 4:
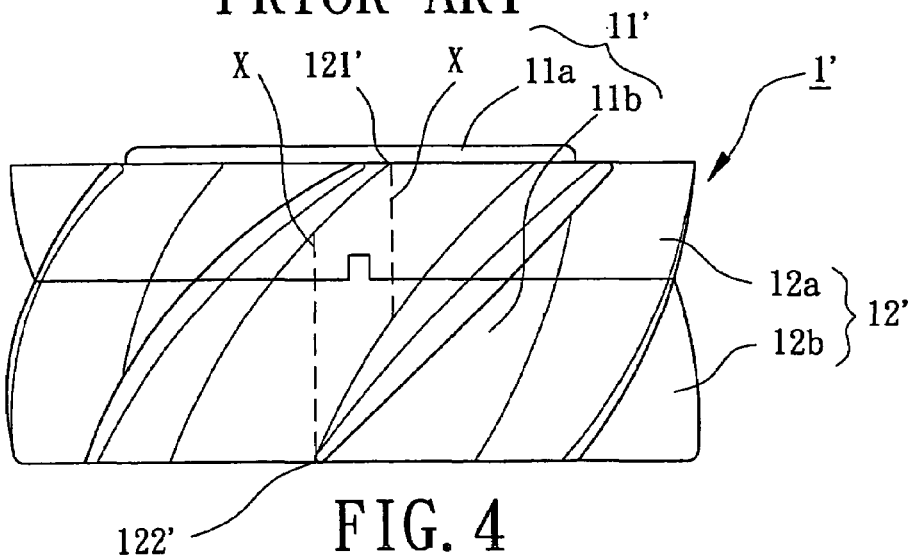
FIG. 4 PRIOR ART
FIG. 4 is a side elevational view of the assembled fan wheel structure in accordance with the prior art.

Referring back to FIGS. 4 and 5, since each of the extension fan blades 211, 221, 231 is integrally extended from the corresponding hub unit 21, 22, 23, the present invention can avoid failure in adhesion or deviation in alignment of the assembled fan blades 12' of the conventional fan wheel 1', as shown in FIG. 4. It will be apparent from the aforementioned discussions that total driven air amount of the fan wheel assembly 2 of the present invention is increased.

Figure 9:
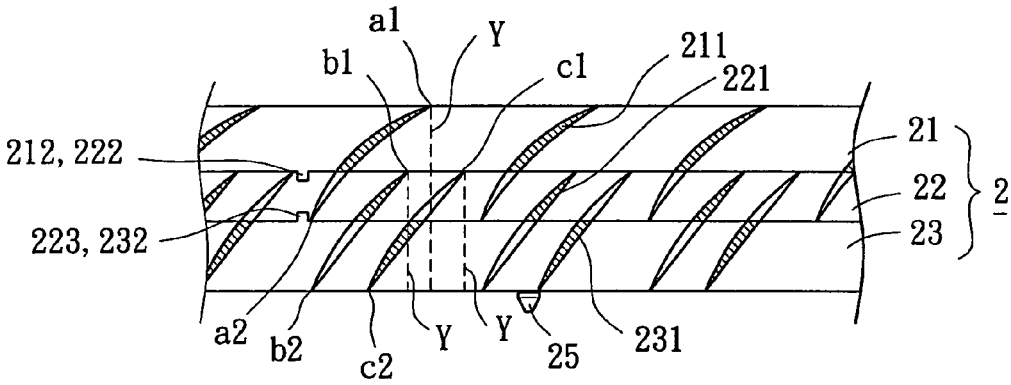
FIG. 9 is a side elevational, schematic view of an assembled fan wheel assembly for connecting multiple hub rings in accordance with a second embodiment of the present invention.

Turning now to FIG. 9, reference numerals of the fan wheel assembly 2 in accordance with the second embodiment of the present invention have applied the identical numerals of the first embodiment, as shown in FIG. 5. The construction of the fan wheel assembly in accordance with the second embodiment of the present invention has similar configuration and same function as that of the first embodiment and detailed descriptions may be omitted.

Referring to FIG. 9, in comparison with the first embodiment, the leading edges (a1, b1, c1) of the extension fan blades 211, 221, 231 of the second embodiment can be modified and varied to predetermined positions according to demand. Firstly, for instance, each leading edge (a1) of the first extension fan blades 211 is substantially parallel to the top surface of the upper hub unit 21 while each trailing edge (a2) of the first extension fan blades 211 being substantially terminated at the bottom plane of the intermediate hub unit 22. Secondly, each leading edge (b1) of the second extension fan blades 221 is substantially parallel to the top plane of the intermediate hub unit 22 while each trailing edge (b2) of the second extension fan blades 221 being substantially terminated at the bottom plane of the lower hub unit 23. Finally, each leading edge (c1) of the third extension fan blades 231 is substantially parallel to the top plane of the intermediate hub unit 22 while the trailing edge (c2) of the third extension fan blades 231 being substantially terminated at the bottom plane of the lower hub unit 23.

Figure 10:
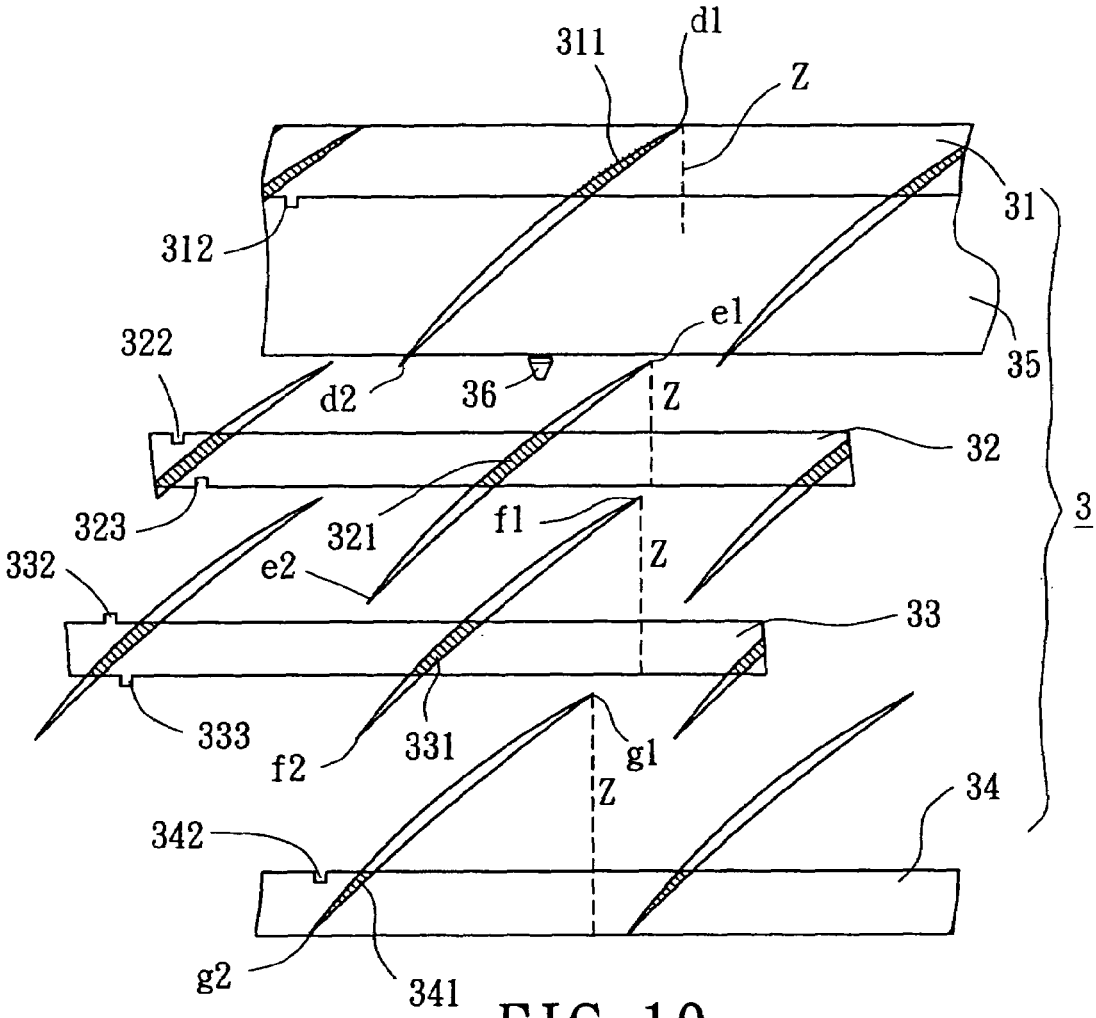
FIG. 10 is an exploded schematic, perspective view of the fan wheel assembly for connecting four hub rings in accordance with the second embodiment of the present invention.
Figure 11:
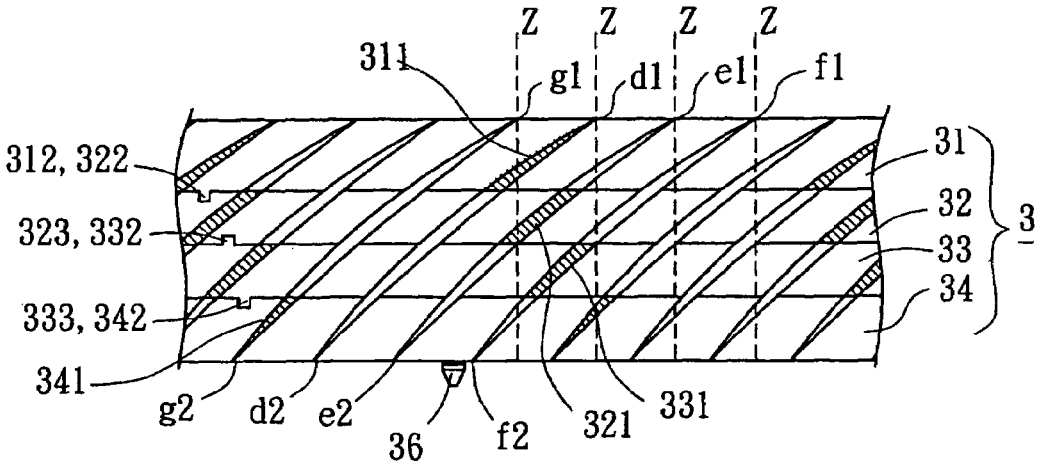
FIG. 11 is a side elevational, schematic view of an assembled fan wheel assembly for connecting four hub rings in accordance with a third embodiment of the present invention.

Referring to FIGS. 10 and 11, as is known in the previous embodiments, a fan wheel 3 in accordance with a third embodiment of the present invention includes an upper hub unit 31, at least two intermediate hub units 32, 33, a lower hub unit 34 and a connecting member 35. An outer circumference of the upper hub unit 31 provides with a plurality of first extension fan blades 311 and at least one engaging member 312. Each of the first extension fan blades 311 includes a leading edge (d1) and a trailing edge (d2). An outer circumference of the intermediate hub unit 32 provides with a plurality of second extension fan blades 321 and at least two engaging members 322, 323. Each of the second extension fan blades 321 includes a leading edge (e1) and a trailing edge (e2). Another outer circumference of the intermediate hub unit 33 provides with a plurality of third extension fan blades 331 and at least two engaging members 332, 333. Each of the third extension fan blades 331 includes a leading edge (f1) and a trailing edge (f2). Another outer circumference of the lower hub unit 34 provides with a plurality of fourth extension fan blades 341 and at least one engaging members 342. Each of the fourth extension fan blades 341 includes a leading edge (g1) and a trailing edge (g2).

Still referring to FIGS. 10 and 11, after assembling, the leading edges (d1, e1, f1, g1) of all of the extension fan blades 311, 321, 331, 341 are substantially parallel to the top surface of the upper hub unit 31 while the trailing edges (d2, e2, f2, g2) of all of the extension fan blades 311, 321, 331, 341 being substantially parallel to the bottom plane of the lower hub unit 34, as best shown in FIG. 11. The engaging members 312, 322, 323, 332, 333, 342 are engaged each other in a longitudinal direction to assemble the upper hub unit 31, the two intermediate hub units 32, 33 and the lower hub unit 34. Desirably, the connecting member 35 is pre-connected with one of the upper hub unit 31, the two intermediate hub unit 32, 33 and the lower hub unit 34 for ease manufacture. Furthermore, the upper hub unit 31 mounts a rotary shaft 36 at its center and thus combines with a motor structure (not shown).

Referring again to FIGS. 4 and 10, since each of the extension fan blades 311, 321, 331, 341 is integrally extended from the corresponding hub units 31, 32, 33, 34, the present invention can avoid failure in adhesion or deviation in alignment of the assembled fan blades 12' of the conventional fan wheel 1', as shown in FIG. 4. It will be apparent from the aforementioned discussions that total driven air amount of the fan wheel assembly 3 of the present invention is increased.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A fan wheel assembly for connecting multiple hub rings, comprising:

an upper hub unit including a plurality of first extension fan blades extended from its outer circumference;

at least one intermediate hub unit including a plurality of second extension fan blades extended from its outer circumference;

a lower hub unit including a plurality of third extension fan blades extended from its outer circumference; and a connecting member serially connecting the hub units which are stacked in a longitudinal direction to constitute the fan wheel assembly;

wherein each extension fan blade of one of the hub units extends into two adjacent extension fan blades of the other two of the hub units that one layer of the extension fan blades overlaps the other two layers of the extension fan blades along a longitudinal direction.

2. The fan wheel assembly for connecting multiple hub rings as defined in claim 1, wherein the first extension fan blade of the upper hub unit includes a leading edge and a trailing edge; wherein the leading edge is substantially parallel to a top surface of the upper hub unit, and correspondingly the trailing edge is substantially parallel to a bottom plane of the lower hub unit.

3. The fan wheel assembly for connecting multiple hub rings as defined in claim 1, wherein the second extension fan blade of the intermediate hub unit includes a leading edge and a trailing edge; wherein the leading edge is substantially parallel to a top surface of the upper hub unit, and correspondingly the trailing edge is substantially parallel to a bottom plane of the lower hub unit.

4. The fan wheel assembly for connecting multiple hub rings as defined in claim 1, wherein the third extension fan blade of the lower hub unit includes a leading edge and a trailing edge; wherein the leading edge is substantially parallel to a top surface of the upper hub unit, and correspondingly the trailing edge is substantially parallel to a bottom plane of the lower hub unit.

5. The fan wheel assembly for connecting multiple hub rings as defined in claim 1, wherein the first extension fan blade of the upper hub unit includes a leading edge and a trailing edge; wherein the leading edge is substantially parallel to a top surface of the upper hub unit, and correspondingly the trailing edge is substantially parallel to a bottom plane of the intermediate hub unit.

6. The fan wheel assembly for connecting multiple hub rings as defined in claim 1, wherein the second extension fan blade of the intermediate hub unit includes a leading edge and a trailing edge; wherein the leading edge is substantially parallel to a top plane of the intermediate hub unit, and correspondingly the trailing edge is substantially parallel to a bottom plane of the lower hub unit.

7. The fan wheel assembly for connecting multiple hub rings as defined in claim 1, wherein the third extension fan blade of the lower hub unit includes a leading edge and a trailing edge; wherein the leading edge is substantially parallel to a top plane of the intermediate hub unit, and correspondingly the trailing edge is substantially parallel to a bottom plane of the lower hub unit.

8. The fan wheel assembly for connecting multiple hub rings as defined in claim 1, wherein the upper hub unit, the intermediate hub unit and the lower hub unit are aligned and engaged each other by a plurality of engaging members.

9. The fan wheel assembly for connecting multiple hub rings as defined in claim 8, wherein the engaging member is selected from a protrusion and a notch.

10. The fan wheel assembly for connecting multiple hub rings as defined in claim 1, wherein the connecting member is a separate tube member made of relatively rigid metal material.

11. The fan wheel assembly for connecting multiple hub rings as defined in claim 10, wherein the separate connecting member serially connects the hub units which are coaxially stacked in a longitudinal direction.

12. The fan wheel assembly for connecting multiple hub rings as defined in claim 10, wherein the connecting member is pre-connected with one of the upper hub unit, the intermediate hub unit and the lower hub unit.

13. The fan wheel assembly for connecting multiple hub rings as defined in claim 1, wherein the upper hub unit mounts a rotary shaft at its center.

* * * * *